United States Patent [19]

Wiehe et al.

[11] Patent Number: 5,006,223

[45] Date of Patent: Apr. 9, 1991

[54] ADDITION OF RADICAL INITIATORS TO RESID CONVERSION PROCESSES

[75] Inventors: Irwin A. Wiehe, Baton Rouge, La.; Martin L. Gorbaty, Westfield; William N. Olmstead, Murray Hill, both of N.J.

[73] Assignee: Exxon Research and Engineering Company, Florham Park, N.J.

[21] Appl. No.: 414,352

[22] Filed: Sep. 29, 1989

[51] Int. Cl.[5] ..... C10G 9/32

[52] U.S. Cl. ..... 208/125; 208/106; 208/127

[58] Field of Search ..... 208/106, 128, 127, 131, 208/48 AA

[56] References Cited

U.S. PATENT DOCUMENTS

| | | | |
|---|---|---|---|
| 2,501,602 | 3/1950 | Hartough et al. | 208/291 |
| 2,859,172 | 11/1958 | Reymond | 208/291 |
| 3,013,965 | 12/1961 | Ferrara et al. | 208/291 |
| 3,707,459 | 12/1972 | Mason et al. | 208/106 |
| 4,051,014 | 9/1977 | Masologites | 208/127 |
| 4,298,455 | 11/1981 | Huang | 208/48 AA |
| 4,425,223 | 1/1984 | Miller | 208/48 AA |
| 4,756,819 | 7/1988 | Bousquet et al. | 208/106 |
| 4,778,586 | 10/1988 | Bain et al. | 208/125 |
| 4,784,744 | 11/1988 | Rudnick | 208/48 AA |

*Primary Examiner*—Anthony McFarlane
*Attorney, Agent, or Firm*—Joseph J. Dvorak

[57] ABSTRACT

The present invention is predicated on the discovery that the addition of certain free radical initiators to thermal conversion processes results in increased thermal conversion rate at a given temperature without any substantial increase in the amounts of gaseous products formed. This permits operating the thermal conversion process at lower temperatures than otherwise practical. Indeed, the present invention is especially useful in thermal cracking processes like fluid coking. In this embodiment, a free radical initiator is added, without the addition of a hydrogen donor diluent, to a feedstock which is thermally cracked in a fluidized bed of particulate solids and at lower temperatures than otherwise employed, thereby increased amounts of liquid products are obtained.

11 Claims, No Drawings

ADDITION OF RADICAL INITIATORS TO RESID CONVERSION PROCESSES

FIELD OF THE INVENTION

This invention relates generally to improvements in thermal processes for treatment of petroleum hydrocarbons. More particularly, the present invention is concerned with free radical promotion of the thermal conversion of petroleum residua into more useful products.

BACKGROUND OF THE INVENTION

There are a wide variety of thermal processes used in the treatment of petroleum hydrocarbons, particularly heavy hydrocarbon feedstocks. As is well known, these thermal processes are predominantly used for breaking the covalent bonds of the hydrocarbons in the feedstock to convert the feedstock into products that have boiling points lower than the feedstock. Illustrative thermal processes include visbreaking, catalytic hydroconversion, hydrogen donor diluent cracking, fluid coking and delayed coking.

For example, U.S. Pat. No. 4,298,455 discloses a thermal visbreaking process in which a heavy oil is subjected to thermal treatment in the presence of a chain transfer agent and free radical initiator, the combined effect of which is to inhibit the polymerization of lower molecular weight hydrocarbons produced during the visbreaking treatment.

In U.S. Pat. No. 4,378,288 there is disclosed a method of increasing coker distillate yield in a thermal coking process by adding a small amount of a free radical inhibitor.

U.S. Pat. No. 4,642,175 discloses a method for reducing the coking tendency of heavy hydrocarbon feedstocks in a non-hydrogenative catalytic cracking process by treating the feedstock with a free radicalremoving catalyst so as to reduce the free radical concentration of the feedstock.

French Patent 0269515 discloses the use of oxygenated sulfur or nitrogen compound in combination with hydrogen-donating diluents in visbreaking heavy petroleum fractions.

Notwithstanding any advantages the foregoing processes may have, there is need to be able to operate thermal residual conversion processes at ever lower temperatures in order to increase the conversion of feed to desirable products. Unfortunately, as is known in the art, if the temperature of a thermal conversion process is decreased so as to increase the conversion of feed to more desirable products, generally it is necessary to increase the residence time of the feed in the reactor. Increased residence time, of course, results in lowering of production rate, which is undesirable. Decreasing the temperature of a thermal conversion process can have other undesirable effects. For example, in fluid coking, lower temperature conversion typically results in gross agglomeration of the fluid bed of coke and the bed of coke becomes unstable because of the lower cracking rate of the resid feed. On the other hand, if the temperature of the conversion process is raised, production rate will increase but at the expense of forming less valuable gaseous products, such as products boiling below 100° F. Moreover, higher conversion temperatures generally make coke formation at the heated walls of the reactor likely, which is clearly undesirable. Thus, there remains a need for increasing the rate of thermal conversion processes without forming less desirable products and preferably increasing both the rate of conversion and yield of desired products.

SUMMARY OF THE INVENTION

Simply stated, the present invention is predicated on the discovery that the addition of certain free radical initiators to thermal conversion processes, without added hydrogen-donor diluents, results in increased thermal conversion rate at a given temperature without any substantial increase in the amount of gaseous products formed. This permits operating the thermal conversion process at a temperature lower than the given temperature with the production of decreased amounts of gaseous products and increased amounts of low boiling liquid products. Basically, the free radical initiators are selected from compounds that are substantially thermally stable at temperatures below the temperatures used in carrying out the thermal conversion process, but that will spontaneously thermally crack at the thermal conversion process conditions to form free radicals at a rate higher than that formed by the feed.

Indeed, the present invention is especially useful in thermal cracking processes, especially fluid bed processes. In this embodiment, a free radical initiator is added to a feedstock which is thermally cracked in a fluidized bed of particulate solids at a given temperature in the absence of added hydrogendonor diluents, the amount of free radical initiator added being sufficient to increase the rate of cracking at the given temperature without any substantial increase in the formation of gaseous products, and thermally cracking the feedstock at a temperature lower than the given temperature whereby increased amounts of low boiling liquid products are produced.

DETAILED DESCRIPTION OF THE INVENTION

The principal charging stock for carrying out thermal conversion processes in which the principles of the present invention are particularly applicable include high boiling virgin or cracked petroleum residues which are typically unsuitable as heavy fuel oils. A typical crude oil feedstock useful in thermal conversion processes has the composition and properties set forth in Table 1 below.

TABLE 1

| TYPICAL FEEDSTOCK | |
|---|---|
| Conradson Carbon | 23.2 wt. % |
| Sulfur | 6.0 wt. % |
| Hydrogen | 9.8 wt. % |
| Nitrogen | 0.48 wt. % |
| Carbon | 83.1 wt. % |
| Metals | 269 wppm |
| Boiling Point | 565° C.+ |
| Gravity | 3.0° API |

Most of the suitable feedstocks used in the practice of the present invention will have compositions and properties within the following ranges, set forth in Table 2:

TABLE 2

| RANGES OF FEEDSTOCK | |
|---|---|
| Conradson Carbon | 5 to 50 wt. % |
| Sulfur | 1.5 to 8.0 wt. % |
| Hydrogen | 9 to 11 wt. % |
| Nitrogen | 0.2 to 2 wt. % |
| Carbon | 80 to 86 wt. % |

TABLE 2-continued

| RANGES OF FEEDSTOCK | |
|---|---|
| Metals | 1 to 500 wppm |
| Boiling Point | 340° C.+ to 650°+ |
| Gravity | −10° to 35° API |

The thermal processes suitable in the practice of the present invention include those thermal treatment methods known in the art such as delayed, fluid and moving bed coking processes, visbreaking, catalytic hydroconversion, thermal cracking, and the like. Indeed, this invention is particularly suited to fluid coking processes. The precise techniques for carrying out these processes are well known.

It is an essential feature of the present invention to add free radical initiators to the feedstock used in thermal conversion processes in an amount sufficient to increase the thermal conversion rate of the feedstock at a given temperature and to conduct that thermal conversion process at a temperature lower than the given temperature to thereby produce more desirable lower boiling products in lieu of less desirable gaseous products. Importantly, the feedstock is subjected to a thermal conversion process without having added a hydrogen-donor diluent. Stated differently, the free-radical initiator is added in amounts sufficient to permit conducting the thermal conversion process at lower temperatures than would otherwise be practical. For example, adding sufficient free radical initiator to a thermal conversion process in an amount sufficient to increase the rate of conversion by about 25% permits operating the thermal conversion process at about 10° F. lower, thereby producing more liquid products.

Basically, the free radical initiator used in the present invention is an organic compound that is substantially thermally stable at temperatures below those used in carrying out the thermal conversion process but which have one or more bonds that will spontaneously thermally crack at the conditions at which the thermal conversion process is to be conducted to form free radicals at a rate higher than free radicals formed by the feed. Desirably, the free radical initiator will also have a sufficiently high boiling point or sufficiently low vapor pressure to assure that an effective amount of initiator is present in the feedstock being treated for forming free radicals at process conditions. Typical and useful free radical initiators include polymeric ethers like poly(methylene oxonaphthalene), poly(dimethylene oxonaphthalene), poly(methylene oxobenzene) and the like. In addition to using discrete chemical compounds as free radical initiators, mixtures of compounds may be employed. Indeed, the free radical initiator may be another petroleum residua or liquid petroleum stream that thermally cracks at substantially a higher rate than the feed because it contains more chemical bonds that spontaneously thermally crack at the thermal conversion temperatures. Hondo and Cold Lake vacuum residua are examples of petroleum feeds that are very thermally reactive because of high concentration of free radical initiators.

The amount of free radical initiator added should be an amount sufficient to increase the rate of thermal conversion over that rate of conversion existing in the absence of the added free radical initiator. The precise amount, of course, must be determined based upon the specific free radical initiator employed and the temperature at which the thermal conversion process is going to be conducted. As a general guideline, however, the amount of free radical initiator added to the feed will generally be in the range of about 0.1 to 25 wt. % based on the total weight of feed and free radical initiator.

The thermal conversion process then is preferably conducted at a lower temperature than otherwise, thereby resulting in formation of more desirable products.

The utility of the invention is further illustrated by the following examples.

Comparative Example 1

This example, an Arabian heavy vacuum resid, having the properties set forth in Table 3 below, was thermally cracked under nitrogen at 400° C. for 90 minutes in a tubing bomb. Vacuum distillation of the product out of the tubing bomb yielded 37.2 wt. % of a 950° F.− product.

TABLE 3

| ARAB HEAVY VACUUM RESIDUUM | |
|---|---|
| Conradson Carbon | 22.3 wt. % |
| Sulfur | 5.13 wt. % |
| Hydrogen | 10.18 wt. % |
| Nitrogen | 0.42 wt. % |
| Carbon | 83.67 wt. % |
| Metals (V + Ni) | 245 ppm |
| Boiling Point | 510° C.+ |
| Gravity | 7.8° API |

Comparative Example 2

A Hondo vacuum residuum with the properties shown in Table 4 below was heated for 68 minutes in a tubing bomb under nitrogen vacuum distillation and yielded 45.3 wt. % of 950° F.− product.

Comparative Example 3

In this example, a feedstock was derived from a Hondo vacuum residuum having the properties set forth in Table 3 above by deasphalting the residuum in n-heptane to remove the asphaltenes, absorbing polar aromatics out of the heptane solution with attapulgus clay, evaporating off the n-heptane and filtering the methyl ethyl ketone solution of the remaining oil at −78° C. to remove the MEK saturates, and evaporating off the methyl ethyl ketone to leave the MEK hydroaromatics (called Hondo MEK aromatics). A yield of 13 wt. % was obtained. This Hondo MEK aromatic fraction was thermally cracked in a tubing bomb under nitrogen at 400° C. for 90 minutes. Vacuum distillation out of the tubing bomb of the product yielded 73.6 wt. % of 950° F.− product. This shows that the Hondo MEK aromatics are more thermally reactive than the Arabian Heavy oil of Comparative Example 1.

TABLE 4

| HONDO VACUUM RESIDUUM | |
|---|---|
| Conradson Carbon | 24.6 wt. % |
| Sulfur | 7.00 wt. % |
| Hydrogen | 9.85 wt. % |
| Nitrogen | 1.23 wt. % |
| Carbon | 82.02 wt. % |
| Metals (V + Ni) | 691 ppm |
| Boiling Point | 524° C.+ |
| Gravity | −0.5° API |

Example 4

This example illustrates the use of a free radical initiator to improve the thermal conversion process. In this example, a mixture of 76.6 weight percent of Arabian Heavy 950° F.+ oil having the properties set forth in Table 3 of Example 1 and 23.4 wt. % percent of the Hondo MEK aromatics from Example 2 above were reacted for 90 minutes at 400° C. under nitrogen in a tubing bomb. Vacuum distillation of the product out of the tubing bomb yielded 51.6 weight percent of 950° F.− product. The expected yield of 950° F.− product was 45.7 weight percent. Since a significantly higher yield of 950° F.− product was actually obtained, this indicates that the Hondo MEK aromatics increased the thermal cracking rate of the Arabian Heavy Vacuum resid. The conversion of Arabian Heavy 950° F.+ increase from 37.2 wt. % to 44.9 wt. % under the same time and temperature Thus, this example demonstrates that the thermal cracking reactivity of a residuum can be increased at a constant temperature by co-reacting the residuum with a more thermally reactive petroleum stream.

Example 5

This example illustrates the use of a polymer free radical initiator to improve the resid thermal conversion process. Here, a polyether of the following structure

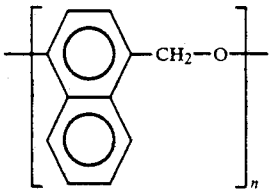

was used in which n was about 100. Two mixtures of this polymer (5 and 10 wt. %) and Arabian Heavy 1289° F.+ were prepared by dissolving the components in toluene and evaporating off the toluene. The rate of formation of volatile products from thermally cracking these mixtures was measured by rapidly heating in a Thermogravimetric Analyzer (TGA) to 510° C. and measuring accurately the rate of weight loss with time. As compared with the Arabian Heavy 1289° F.+, the mixture containing 5% polymer increased the rate of conversion by 27% and the mixture containing 10% polymer increased the rate of conversion by 48%. This means that with 5 wt. % polymer, the conversion temperature could have been lowered from 510° C. to 504° C. without decreasing the cracking rate. With 10 wt. % polymer, the conversion temperature could have been lowered from 510° C. to 501° C.

Example 6

In this example, a mixture of 75 wt. % of an Arabian heavy vacuum resid having the properties set forth in Table 3 and 15 wt % of a Hondo vacuum resid having the properties set forth in Table 4 was heated for 68 minutes at 400° C. in a tubing bomb under nitrogen. A yield of 40.4 wt % of 950° F.− product was obtained, which was greater than 35.2 wt % of 950° F.− that is calculated from the data in Comparative Examples 1 and 2.

What is claimed is:

1. In a thermal conversion process wherein a petroleum feedstock is heated at elevated temperatures to form low boiling liquid products and wherein gaseous products are formed, the improvement consisting essentially of: carrying out the thermal conversion in the presence of a free radical initiator and in the absence of added hydrogen-donor diluent, the free radical initiator being present in an amount sufficient to increase the rate of thermal conversion without substantially increasing the formation of gaseous products.

2. The improvement of claim 1 wherein the free radical initiator is selected from organic compounds and mixtures thereof that have a sufficiently high boiling point to remain present in the feedstock under process conditions and that will spontaneously thermally crack under process conditions to form free radicals at a rate higher than free radicals formed by the feed.

3. The improvement of claim 2 wherein free radical initiator is present in an amount ranging between about 0.1 wt. % to about 25 wt. % based on total weight of feedstock and initiator.

4. The improvement of claim 3 wherein the initiator is a petroleum residuum or fraction thereof that cracks at a higher rate than the feedstock.

5. The improvement of claim 3 wherein the initiator is a polymeric ether.

6. The improvement of claim 5 wherein the polymeric ether is selected from poly(methylene oxonaphthalene), poly(dimethylene oxonaphthalene) and poly(-methylene oxobenzene).

7. A process for converting a petroleum feedstock to liquid products consisting essentially of:

subjecting the feedstock to a thermal conversion process selected from the group consisting of delayed coking, fluid coking, visbreaking, and thermal cracking in the presence of a free radical initiator and in the absence of added hydrogen-donor diluent, the amount of free radical initiator being sufficient to increase the rate of thermal conversion without substantially increasing the formation of gaseous products.

8. The process of claim 7 wherein the free radical initiator is selected from organic compounds and mixtures thereof that will spontaneously thermally crack under conditions of use to form free radicals at a rate higher than free radicals formed by the feed.

9. The process of claim 8 wherein the free radical initiator is present in an amount ranging between about 0.1 wt. % to about 25 wt. % based on total weight of feedstock and initiator.

10. The process of claim 9 wherein the thermal conversion process is fluid coking and the temperature at which the fluid coking is conducted is a lower temperature than that in the absence of the free radical initiator.

11. In a fluid coking process wherein a petroleum feedstock is heated in a fluidized bed of particulate solids at temperatures and pressures sufficient to convert at least some of the feedstock to liquid products, the improvement consisting essentially of:

conducting the fluid coking process in the presence of a free radical initiator and in the absence of any added hydrogen donor diluent, the free radical initiator being selected from compounds and mixtures thereof that have a sufficiently high boiling point to remain present in the feedstock under the process conditions and that will spontaneously thermally crack at the fluid coking process conditions to form free radicals at a rate higher than that formed by the feedstock, the free radical initiator being used in an amount sufficient to increase the rate of thermal conversion over that in the absence of the free radical initiator, and conducting the fluid coking process at lower temperatures than otherwise employed in fluid coking processes conducted in the absence of the free radical, whereby increased amounts of liquid products are obtained.

* * * * *